US010724177B2

(12) United States Patent
Carstensen

(10) Patent No.: US 10,724,177 B2
(45) Date of Patent: Jul. 28, 2020

(54) SYSTEMS AND METHODS FOR PROVIDING FLUID EXTRACTION VACUUM BOX COVERS WITH INTEGRAL LUBRICATION

(71) Applicant: Kadant Inc., Westford, MA (US)

(72) Inventor: Peter Thuroe Carstensen, Adirondack, NY (US)

(73) Assignee: Kadant Inc., Westford, MA (US)

( * ) Notice: Subject to any disclaimer, the term of this patent is extended or adjusted under 35 U.S.C. 154(b) by 0 days.

(21) Appl. No.: 16/022,504

(22) Filed: Jun. 28, 2018

(65) Prior Publication Data

US 2019/0003117 A1 Jan. 3, 2019

Related U.S. Application Data

(60) Provisional application No. 62/526,098, filed on Jun. 28, 2017.

(51) Int. Cl.

| | |
|---|---|
| ***D21F 7/12*** | (2006.01) |
| ***D21F 1/52*** | (2006.01) |
| ***D21F 3/02*** | (2006.01) |
| *D21F 1/40* | (2006.01) |

(52) U.S. Cl.

CPC ..... *D21F 7/12* (2013.01); *D21F 1/523* (2013.01); *D21F 3/0272* (2013.01); *D21F 1/40* (2013.01)

(58) Field of Classification Search

USPC ..... 162/359.1, 217, 208

See application file for complete search history.

(56) References Cited

U.S. PATENT DOCUMENTS

| | | | |
|---|---|---|---|
| 1,216,861 | A | 2/1917 | Shorey et al. |
| 1,534,854 | A | 4/1925 | Lewis |
| 2,957,522 | A | 10/1960 | Gatke |
| 3,053,319 | A | 9/1962 | Cronin et al. |
| 4,011,131 | A | 3/1977 | Nicholson |
| 4,909,906 | A | 3/1990 | Bartelmuss et al. |
| 5,147,508 | A | 9/1992 | Sweet |
| 8,557,086 | B2 | 10/2013 | Eronen et al. |
| 2007/0144699 | A1 | 6/2007 | McPherson |
| 2019/0003116 | A1* | 1/2019 | Carstensen ..... D21F 5/14 |

FOREIGN PATENT DOCUMENTS

| | | |
|---|---|---|
| FR | 2637622 A1 | 4/1990 |
| GB | 1118290 A | 6/1968 |

OTHER PUBLICATIONS

International Search Report & Written Opinion issued by International Searching Authority in related International Patent Application No. PCT/US2018/040132 dated Oct. 10, 2018, 14 pgs.

International Preliminary Report on Patentability issued by the International Bureau of WIPO dated Dec. 31, 2019 in related International Application No. PCT/US2018/040128, 8 pages.

(Continued)

*Primary Examiner* — Mark Halpern

(74) *Attorney, Agent, or Firm* — Gesmer Updegrove LLP

(57) ABSTRACT

A system is disclosed for removing fluids from a felt in a paper making process. The system includes a fluid in a reservoir that is adapted to permit a surface of the fluid to contact an underside of the felt.

9 Claims, 7 Drawing Sheets

(56) References Cited

OTHER PUBLICATIONS

International Preliminary Report on Patentability issued by the International Bureau of WIPO dated Dec. 31, 2019 in related International Application No. PCT/US2018/040132, 8 pages.
International Search Authority and Written Opinion of the International Searching Authority dated Oct. 8, 2018 in related International Application No. PCT/US2018/040128, 12 pages.
Communication pursuant to Rules 161(1) and 162 EPC issued by the European Patent Office dated Feb. 4, 2020 in related European Patent Application No. 18743302.4, 3 pages.

* cited by examiner

SYSTEMS AND METHODS FOR PROVIDING FLUID EXTRACTION VACUUM BOX COVERS WITH INTEGRAL LUBRICATION

PRIORITY

The present application claims priority to U.S. Provisional Patent Application Ser. No. 62/526,098 filed Jun. 28, 2017, the disclosure of which is hereby incorporated by reference in its entirety.

BACKGROUND

The invention generally relates to paper making systems and processes, and relates in particular, to systems and processes for facilitating the removal of fluids from paper-making material during paper making processes.

In the paper making process the press section is equipped with conveying belts commonly referred to as felts. The felts act to carry the newly formed, very wet paper to the pressing rolls where a considerable amount of water is forced out of the paper and into the felts. As these felts are serpentine in nature, it is necessary to remove the captured water from the felts so that the process of water removal from the paper is repeated as the continuous supply of newly form paper is processed through the press section.

The existing methods for water extraction from the serpentine felt typically involve the use of a vacuum element in the belt run commonly referred to as the Uhle box, which is typically constructed from a pipe or enclosure that has a contact wear surface attached to it. This contact wear surface incorporates within the design a through path for the vacuum applied water extraction stream to drain into. The vacuum applied to the felt is considerable and causes the felt to be pulled tightly onto the contact wear surface and into the vacuum port open area.

The friction between the two components (felt and contact wear surface) must be minimized to prevent premature component wear and minimize the amount of energy consumed to drive the felts about their serpentine loop. The placement of a water application device commonly known as lube showers, sprays a coating of water onto the felt surface that is to be in contact with the Uhle box contact wear surface to prevent the buildup of friction generated heat and more importantly, to create a film of water for the felt to ride (hydro-plane) on as it travels over the vacuum through path(s) in the cover.

To apply the water the shower is typically located before the Uhle box and is equipped to evenly coat the felt surface through a multitude of nozzles populated on a common pipe, which is commonly referred to as the lube shower. A pressurized water supply insures application of the water to the felt surface. The use of the lube shower however, is not always effective in certain applications.

There remains a need therefore, for more efficient and effective systems for removing fluids from felts while minimizing wear on the felts.

SUMMARY

In accordance with an embodiment, the invention provides a system for removing fluids from a felt in a paper making process. The system includes a fluid in a reservoir that is adapted to permit a surface of the fluid to contact an underside of the felt.

In accordance with another embodiment, the invention provides a method for removing fluids from a felt in a paper making process. The method includes the step of providing a reservoir of fluid in contact with an underside of the felt in advance of a vacuum.

In accordance with a further embodiment, the invention provides a system for removing fluids from a felt in a paper making process. The system includes a fluid in a reservoir that contacts an underside of the felt in advance of a vacuum station.

BRIEF DESCRIPTION OF THE DRAWINGS

The following description may be further understood with reference to the accompanying drawings in which.

Figure 1:
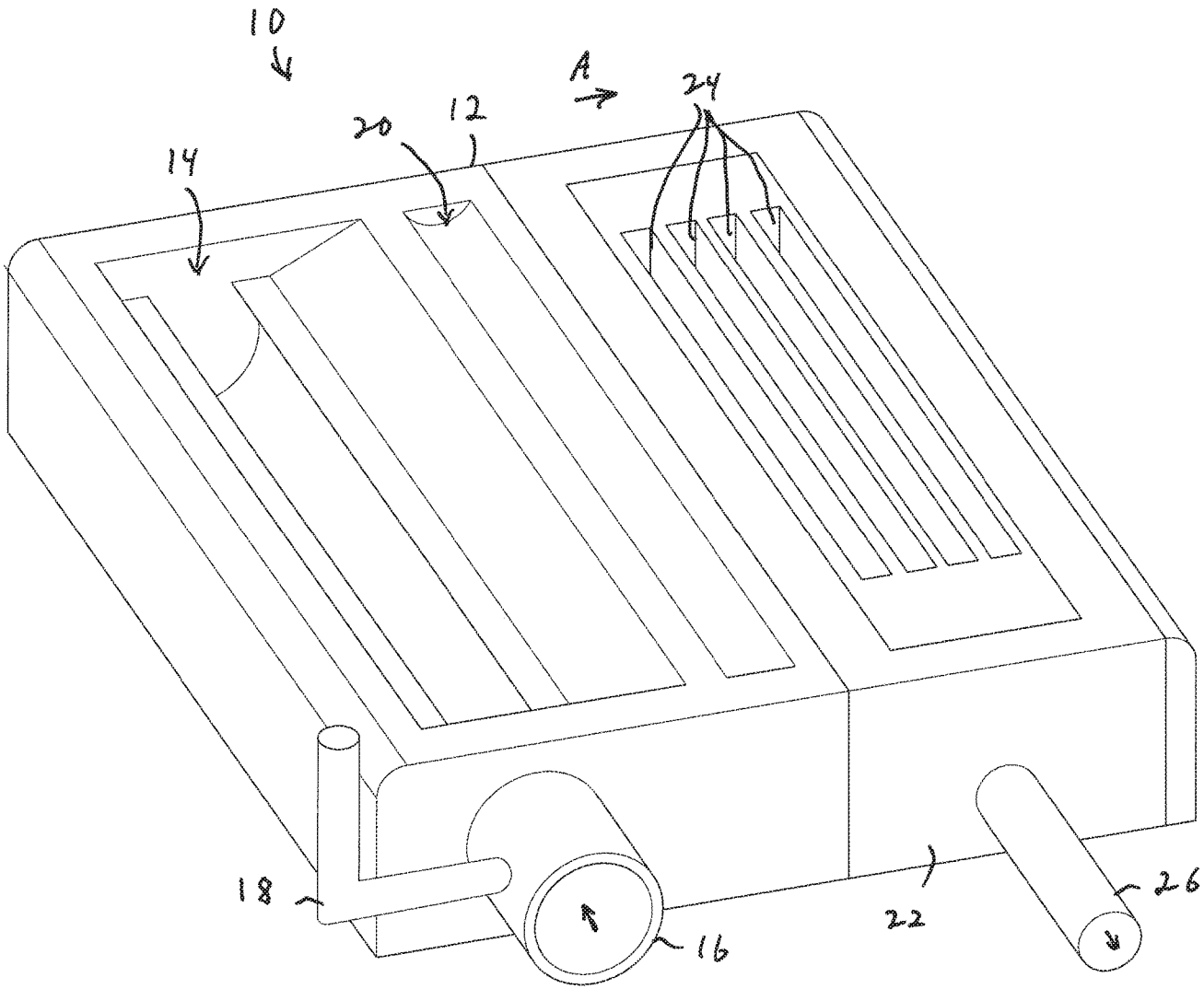
FIG. 1 shows an illustrative diagrammatic view of a fluid removal system in accordance with an embodiment of the present invention.

The drawings are shown for illustrative purposes only.

DETAILED DESCRIPTION

The application of the water film is a critical component of developing the hydro-plane fluid layer between the felt and contact surface. It is imperative that the water remain on the felt surface and not be drawn into the body of the felt. The felt is designed specifically to absorb water in the quickest time possible. This characteristic is critical in the press nip (the area where the water is forced out of the paper sheet and into the felt). The lube shower is located upstream of the Uhle box. The amount of time that the water resides on the felt surface before it travels to the vacuum through path (where the high drag load exists) can be more than 60 ms. This dwell time provides plenty of opportunity for the felt (by design) to absorb the applied lubrication water: hence starving the hydro-plane of the necessary water film. Addressing the time dwell is one issue targeted by the present invention.

The next issue targeted is the amount of water applied that is wasted. Because of the water absorption phenomena detailed above, it becomes necessary to apply much more water to achieve the goal of establishing the water film on the surface, the over application of high quality, heated water for this application also loads the dewatering function of the fluid extraction (Uhle) box and causes the felt to leave the Uhle box with some retained water that lowers the efficiency of the press section. In addition to the above mentioned over applied water volume is the necessity to apply the water spray in a redundant fashion (typically 2×-3×) due to intermittent plugging of the individual nozzles (as discussed further below). Addressing expedient use of high quality water use through a more efficient delivery system is an additional target.

The last issue targeted is the reliability of the presently used lubrication showering systems, and the plugging of nozzles to be more specific. The lubrication shower is typically affixed with a multitude of spray nozzles that incorporate a small diameter orifice (typically 0.020"-0.055" diameter) that are susceptible to plugging. Eliminating the small orifice nozzles addresses this issue.

In accordance with certain embodiments of the present invention, the cover includes a pond or reservoir area containing the lubrication water incorporated within the design. The pond surface level would be maintained so that only the traveling felt surface would contact the lubrication water supply thereby self-applying the water film needed for the hydro-plane lubrication film. The reduction of distance from application point to vacuum through path results in a reduction of saturation dwell time of over 90% (then typical shower applied method), thus mitigating the felts inherent design characteristic to absorb water into the body of the felt. The pond distribution (front to back) needs to be maintained at a consistent level (cross machine) to ensure that the entire width of the felt is coated. The regulator pipe is designed to provide the proper cross machine flow characteristics without the use of small orifice nozzles. The regulator function may also be formed without the use of the regulator pipe by duplicate geometry machined into the cover material.

FIG. 1 shows a system 10 in accordance with an embodiment of the present invention that includes a fluid extraction box 12 including a reservoir area 14 that is in communication with a fluid (e.g., water) source, which provides the fluid such that the fluid level is maintained to be in contact with the underside of the felt as it travels over the fluid extraction box 12 in a direction as generally indicated at A. The fluid is provided by a lube regulator pipe insert 16, and may receive the fluid by a source 18 that may be used by personnel to monitor the level of the fluid in the reservoir during operation. The system 10 may also include a spreader groove 20, which is a recessed area following the reservoir in which fluid may collect and continue to cover the underside of the felt. Following the spreader groove 20 is a vacuum plate 22 that includes a plurality of apertures 24 that are in communication with a vacuum source via a vacuum line 26. The vacuum plate removes fluid from the felt.

Figure 2:
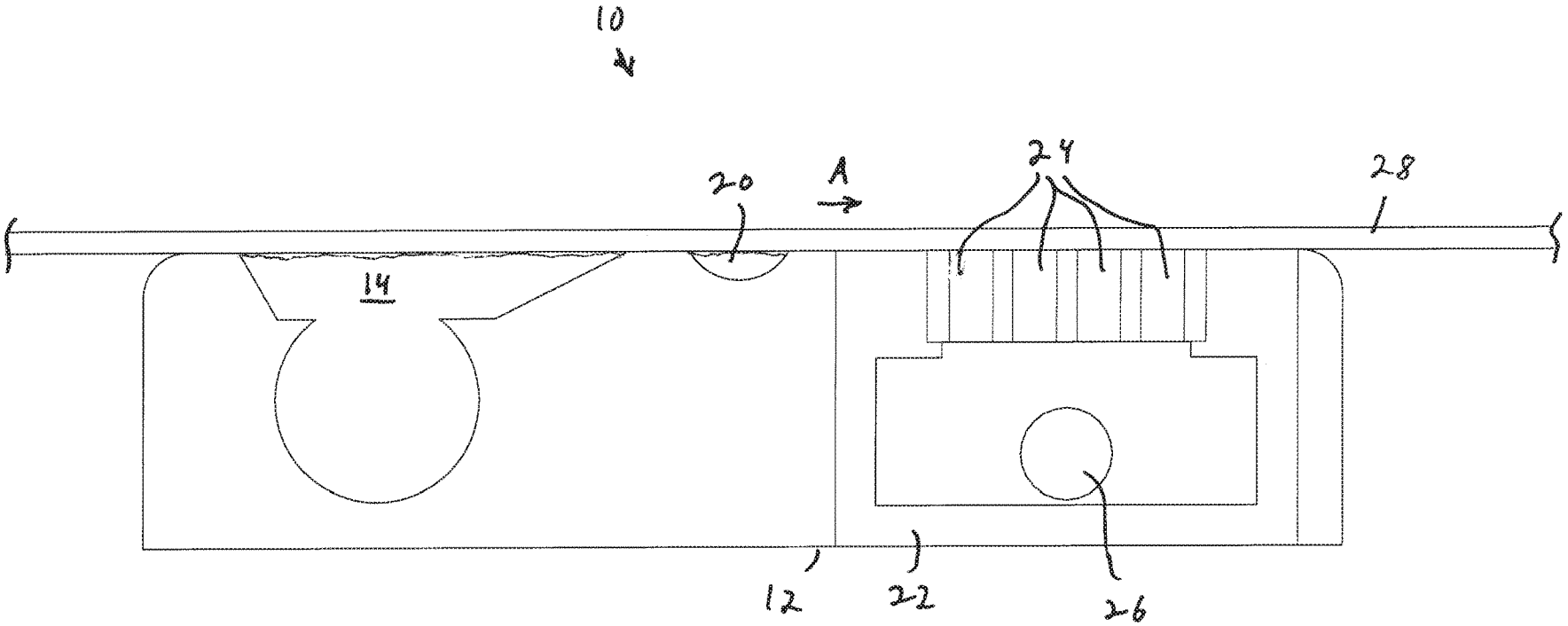
FIG. 2 shows an illustrative diagrammatic sectional side view of the system of FIG. 1.

FIG. 2 shows a sectional side view of the system 10 of FIG. 1 with a felt 28 shown on the top of the fluid extraction box 12. When the felt travels over the wear contact surface of the fluid extraction box (between the spreader groove 20 and the vacuum plate 22), the felt is well lubricated, yet the felt has not had sufficient time to absorb a substantial amount of the fluid.

The spreader groove is an added (redundant) distribution method that is also provided as a negative pulse to further minimize felt saturation. The level (pond water height) is maintained using a flow control valve and feedback control through various means. The simplest would be a visual water column sight gauge. Another method would use the visual water column approach with light beam sensors triggering when the column height is beyond desired operating range thus employing a control algorithm to control flow at the supply valve. Other methods would incorporate pressure feedback loops utilizing commonly used electronic pressure sensors.

Figure 3:
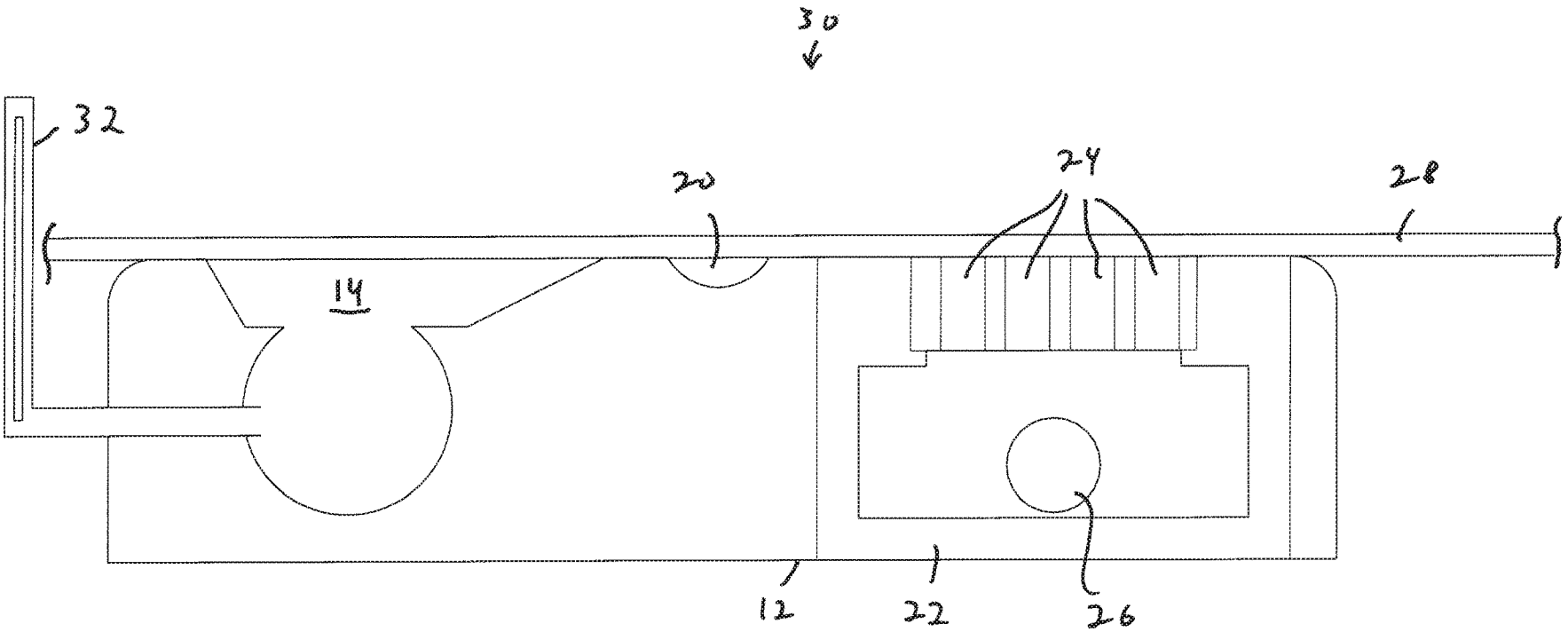
FIG. 3 shows an illustrative diagrammatic sectional side view of a system similar to that of FIG. 1 that includes a sight gage for determining a level of fluid in the reservoir.
Figure 4:
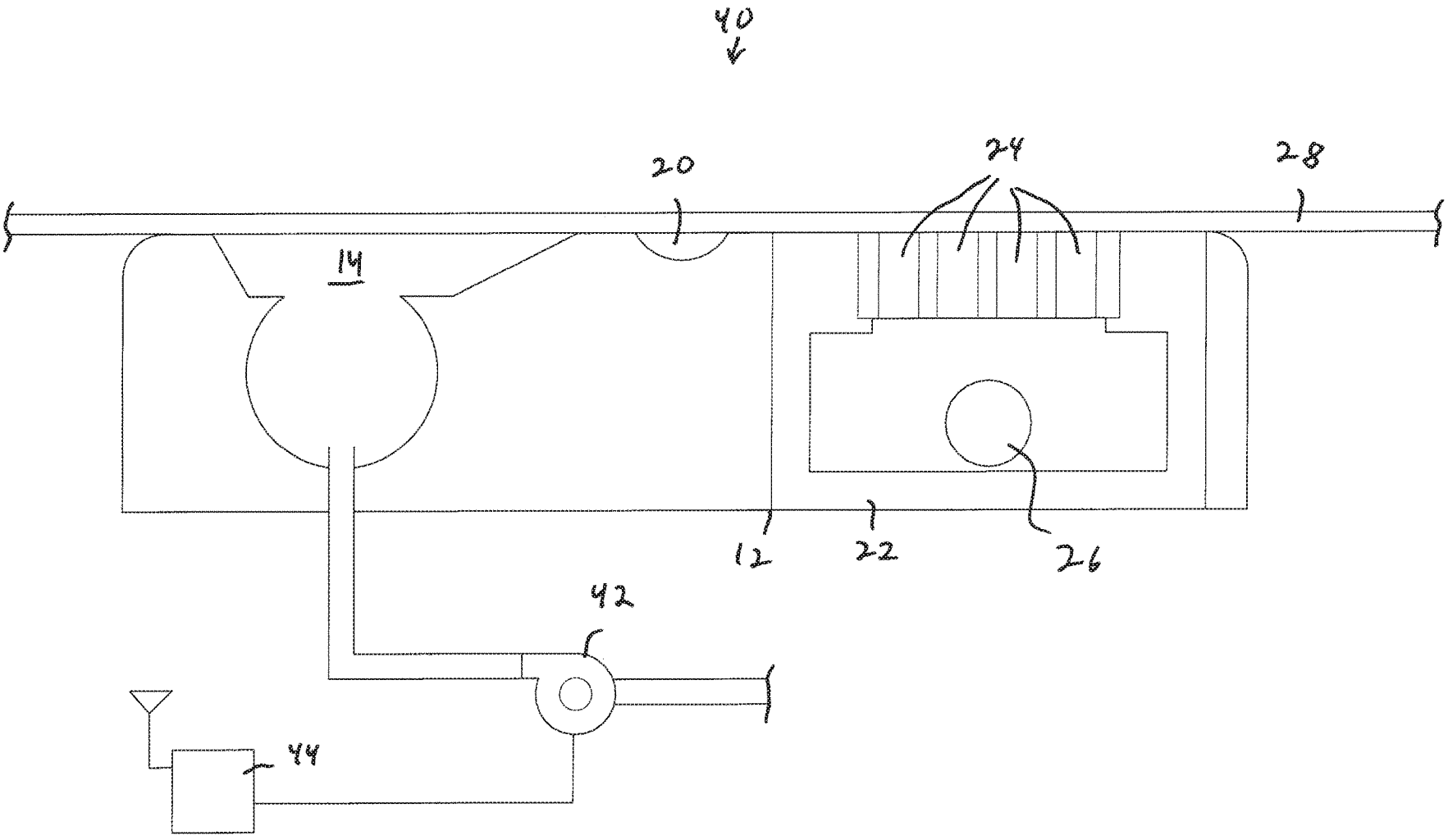
FIG. 4 shows an illustrative diagrammatic sectional side view of a system similar to that of FIG. 1 that includes a positive pressure fluid source.

FIG. 3, for example, shows a system 30 in accordance with another embodiment of the present invention that further includes a sight gauge 32 that may be used by personnel to monitor the level of the fluid in the reservoir during operation. FIG. 4 shows a system 40 that includes positive pressure pump 42 for providing the fluid under positive pressure. The pump may be in communication with a controller 44 that monitors the felt speed and fluid consumption, to maintain a fluid level in the reservoir to ensure that the bottom of the felt remains in contact with the fluid.

Figure 5:
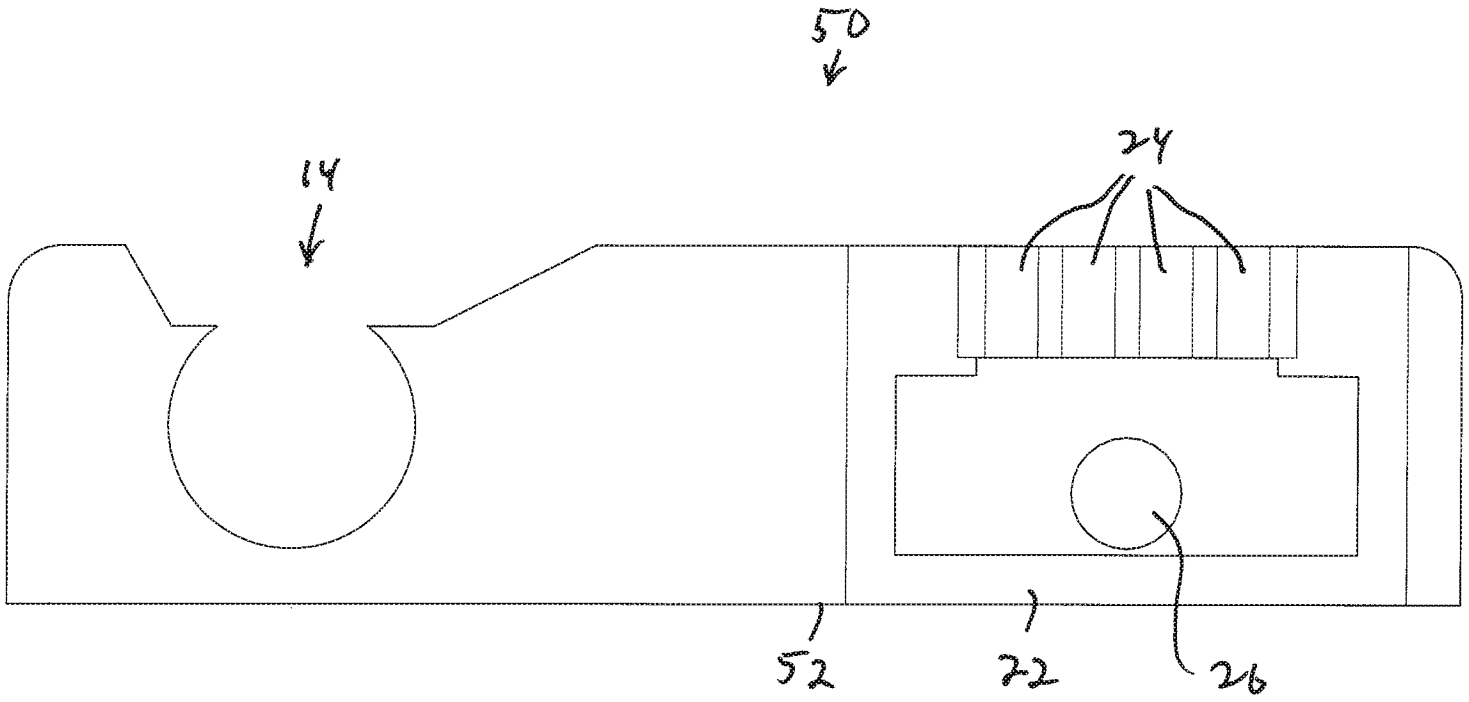
FIG. 5 shows an illustrative diagrammatic sectional side view of a system in accordance with another embodiment of the present invention.

The system 50 of FIG. 5 includes a reservoir area 14 in a fluid extraction box 52, as well as a vacuum plate 22 discussed above that includes slit openings 24 and a vacuum source 26. The system 50, however, includes no spreader groove.

In the systems discussed above, the fluid extraction box system includes a vacuum source for providing vacuum through slit openings in the vacuum plate, in addition to the lube pond and the optional spreader groove. The lube pond provides a fluid that contacts the underside of the moving felt. The fluid is provided by a lube regulator pipe insert as shown, and the spreader groove facilitates an even spreading of the fluid on the underside of the felt.

Figure 6:
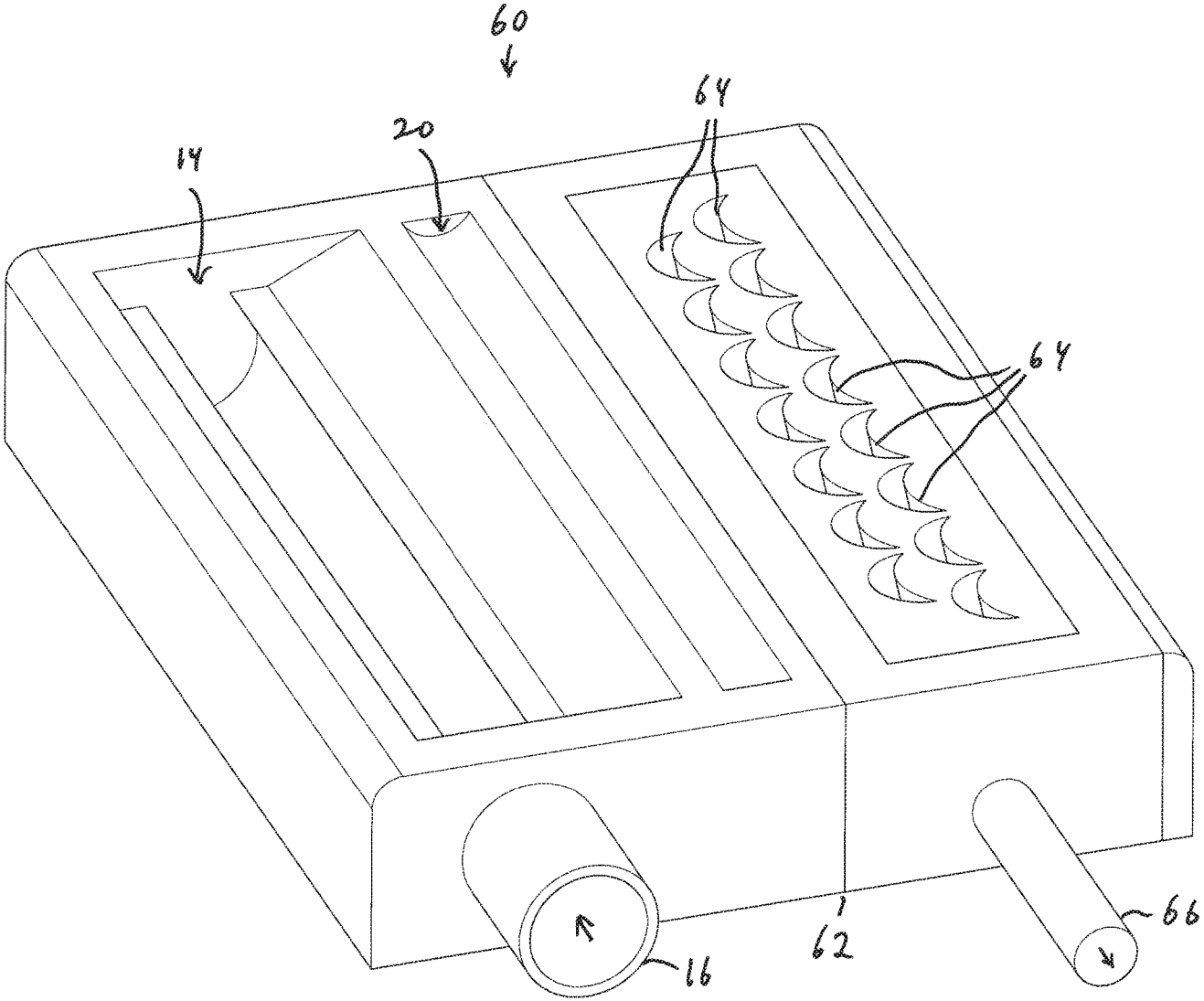
FIG. 6 shows an illustrative diagrammatic view of a fluid removal system in accordance with a further embodiment of the present invention.
Figure 7:
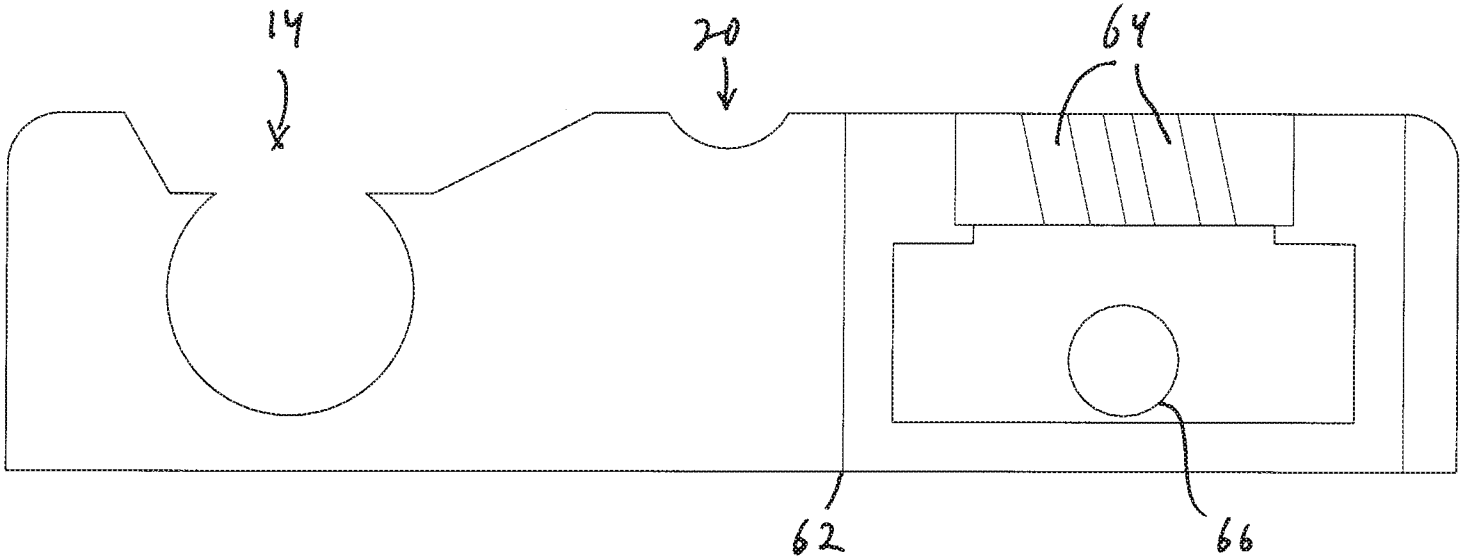
FIG. 7 shows an illustrative diagrammatic sectional side view of the system of FIG. 6.

The system 60 of FIG. 6 similarly includes a reservoir area 14 in a fluid extraction box 62, as well as a lube regulator pipe insert 16 and a spreader groove 20. The system 60 however, includes a vacuum plate 62 having crescent shaped openings 64 that are in communication with a vacuum source 66. FIG. 7 shows a sectional side view of the system of FIG. 6, which shows that the openings 64 are provide channels into the vacuum plate that are at angles to facilitate the extraction of fluid from the felt.

Those skilled in the art will appreciate that numerous modifications and variations may be made to the above disclosed embodiments without departing from the spirit and scope of the present invention.

What is claimed is:

1. A system for removing fluids from a felt in a paper making process, said system comprising a housing that includes a fluid in a reservoir that is adapted to permit a surface of the fluid to contact an underside of the felt as the felt travels over the housing and further includes a spreader groove in the form of a recessed area of the housing for evenly spreading the fluid on the underside of the felt, wherein the spreader groove is separated from the reservoir by a raised surface of the housing that contacts the underside of the felt.

2. The system as claimed in claim 1, wherein the reservoir is provided by a regulator pipe.

3. The system as claimed in claim 1, wherein the system further includes means for monitoring the fluid level within the reservoir.

4. The system as claimed in claim 1, wherein the system further includes a vacuum source in communication with the felt for removing fluid from the felt.

5. The system as claimed in claim 1, wherein the system further includes a controller for controlling the amount of fluid in the reservoir.

6. A system for removing fluids from a felt in a paper making process, said system comprising a housing that includes a fluid in a reservoir that contacts an underside of the felt as the felt travels over the housing in advance of a vacuum station and further includes a spreader groove in the form of a recessed area of the housing for minimizing fluid saturation of the felt, wherein the spreader groove is separated from the reservoir by a raised surface of the housing that contacts the underside of the felt.

7. The system as claimed in claim 6, wherein the reservoir is provided by a regulator pipe.

8. The system as claimed in claim 6, wherein the system further includes means for monitoring the fluid level within the reservoir.

9. The system as claimed in claim 6, wherein the system further includes a controller for controlling the amount of fluid in the reservoir.

* * * * *